US012714156B2

(12) United States Patent
Moyles et al.

(10) Patent No.: US 12,714,156 B2
(45) Date of Patent: Aug. 25, 2026

(54) COOLING UNDERGARMENT

(71) Applicant: Care For There LLC, Carlsbad, CA (US)

(72) Inventors: Thomas Moyles, Carlsbad, CA (US); Jared Moore, Huntersville, NC (US)

(73) Assignee: CARE FOR THERE LLC, Carlsbad, CA (US)

( * ) Notice: Subject to any disclaimer, the term of this patent is extended or adjusted under 35 U.S.C. 154(b) by 0 days.

(21) Appl. No.: 18/829,114

(22) Filed: Sep. 9, 2024

(65) Prior Publication Data

US 2025/0082045 A1 Mar. 13, 2025

Related U.S. Application Data

(60) Provisional application No. 63/537,146, filed on Sep. 7, 2023.

(51) Int. Cl.
*A41B 9/04* (2006.01)
*A41B 17/00* (2006.01)

(52) U.S. Cl.
CPC ..... *A41B 9/04* (2013.01); *A41B 17/00* (2013.01)

(58) Field of Classification Search
CPC ..... A41B 9/001; A41B 9/04; A41B 17/00; A61F 2013/15325; A61F 2007/0236; A61F 2007/2037; A41C 1/003
See application file for complete search history.

(56) References Cited

U.S. PATENT DOCUMENTS 2,114,634 A * 4/1938 Jean ..... A41B 9/02 2/403
2,282,217 A * 5/1942 Flesh ..... A41B 9/02 2/234
2,336,248 A * 12/1943 Harwood ..... A41B 9/02 2/403
2,344,374 A * 3/1944 Stephens ..... A41B 9/04 450/130
2,344,375 A * 3/1944 Stephens ..... A41C 1/00 450/130
2,435,377 A * 2/1948 Wise ..... A41B 9/02 2/403
2,465,913 A * 3/1949 Murdock ..... A41B 9/04 450/104
2,537,412 A * 1/1951 Laguzzi ..... A41C 1/00 450/130
2,558,099 A * 6/1951 Palen ..... A41C 1/003 450/118
2,641,257 A * 6/1953 Rutledge ..... A61F 13/72 2/403
2,867,215 A * 1/1959 Horton ..... A61F 7/02 607/108
2,876,779 A * 3/1959 Ebert ..... A41B 9/04 450/106

(Continued)

*Primary Examiner* — Heather Mangine
*Assistant Examiner* — Raquel M. Weis
(74) *Attorney, Agent, or Firm* — Womble Bond Dickinson (US) LLP

(57) ABSTRACT

A postpartum undergarment is provided to provide both compressive elastic support and non elastic support to the body of the wearer. Compartments formed on a front panel of the garment and in between leg openings of the garment are configured for positioning of thermal packs therein to provide heat or cold therapy to areas of the body of the wearer.

9 Claims, 5 Drawing Sheets

(56) References Cited

U.S. PATENT DOCUMENTS 2,977,959 A * 4/1961 Welsch ..... A41C 1/003 450/130
2,982,287 A * 5/1961 Paveza ..... A41C 1/00 450/156
3,045,678 A * 7/1962 Geimer ..... A41C 1/10 450/130
3,142,302 A * 7/1964 Schonberg ..... A41C 1/003 450/118
3,310,053 A * 3/1967 Greenwood ..... A41C 1/00 450/153
3,459,181 A * 8/1969 Mann ..... A41B 9/02 2/403
3,871,030 A * 3/1975 Green ..... A63B 47/001 2/250
3,882,873 A * 5/1975 Arango ..... A61F 7/02 607/108
4,164,217 A * 8/1979 Schrock ..... A61F 5/37 128/883
4,352,356 A * 10/1982 Tong ..... A61F 13/74 604/397
4,509,512 A * 4/1985 LeClercq ..... A41B 9/008 602/67
4,655,760 A * 4/1987 Morman ..... A61F 13/514 604/385.26
5,093,935 A * 3/1992 Countee, Jr. ..... A41B 9/02 2/403
5,167,655 A * 12/1992 McCoy ..... A61F 13/496 2/408
5,172,430 A * 12/1992 Lerma-Solis ..... A41B 9/02 2/403
5,241,710 A * 9/1993 Lockhart ..... A61F 13/74 2/400
5,243,974 A * 9/1993 Allen ..... A41B 9/02 2/403
5,274,854 A * 1/1994 Wenner ..... A41D 1/089 2/403
5,483,705 A * 1/1996 DiMatteo ..... A63B 71/1216 2/403
5,701,608 A * 12/1997 Kohn ..... A41B 9/04 450/114
5,724,679 A * 3/1998 Hans ..... A41D 27/20 2/249
5,819,323 A * 10/1998 Edenfield ..... A41B 9/02 2/403
5,870,779 A * 2/1999 Heron ..... A41B 9/023 2/403
6,041,445 A * 3/2000 Davitt ..... A61F 5/449 2/400
6,076,195 A * 6/2000 Klein ..... A41B 9/023 2/403
6,308,340 B1 * 10/2001 Cook ..... A41B 9/04 2/400
6,595,973 B2 * 7/2003 Sugito ..... A61F 13/496 604/385.13
6,772,446 B1 * 8/2004 Black ..... A41B 9/04 2/400
8,100,876 B1 * 1/2012 Biondolillo ..... A61F 13/84 604/386
8,321,964 B2 * 12/2012 Gernes ..... A41B 9/001 2/403
8,784,351 B2 * 7/2014 Dumpson ..... A41C 1/10 602/61
9,003,571 B1 * 4/2015 Lewis-Williams ..... A41B 9/04 2/400
10,149,499 B2 * 12/2018 Sklar ..... A41B 9/02
11,510,443 B1 * 11/2022 Richardson ..... A41D 7/005
2003/0028952 A1 * 2/2003 Fujii ..... A41C 1/003 2/400
2004/0127882 A1 * 7/2004 Weber ..... A61F 13/49413 604/385.28
2004/0210205 A1 * 10/2004 VanGompel ..... A61F 13/496 604/385.22
2005/0137548 A1 * 6/2005 Riley ..... A61F 13/8405 604/385.01
2006/0101558 A1 * 5/2006 Coleman ..... A61F 13/84 2/400
2007/0077860 A1 * 4/2007 Brooks ..... A41B 9/04 450/155
2007/0083985 A1 * 4/2007 Nathan ..... A41B 9/001 2/400
2008/0010716 A1 * 1/2008 Brown ..... A41D 13/1254 2/78.1
2008/0189832 A1 * 8/2008 Oscher ..... A41D 7/005 2/400
2009/0118574 A1 * 5/2009 Stephenson ..... A41B 9/04 600/38
2009/0178182 A1 * 7/2009 Dahlquist ..... A61F 5/41 2/403
2010/0114053 A1 * 5/2010 Mandeville ..... A61F 13/84 607/108
2010/0281595 A1 * 11/2010 Gernes ..... A41B 9/001 2/69
2012/0029407 A1 * 2/2012 Sawle ..... A41D 31/185 602/61
2012/0116345 A1 * 5/2012 Dime ..... A61F 13/505 2/403
2013/0212791 A1 * 8/2013 Hocking ..... F41H 1/02 2/2.5
2014/0047620 A1 * 2/2014 Ingalls ..... A41B 9/02 2/403
2014/0358203 A1 * 12/2014 Li ..... A61F 7/00 607/108
2015/0026869 A1 * 1/2015 Groceman ..... A41D 27/20 2/400
2015/0142088 A1 * 5/2015 Riva Godoy ..... A41D 13/0058 607/108
2016/0135512 A1 * 5/2016 Smith ..... A41C 5/00 450/156
2016/0242476 A1 * 8/2016 Nutter ..... A61F 7/02
2017/0224549 A1 * 8/2017 Helit ..... A41B 9/004
2018/0055095 A1 * 3/2018 Waitz ..... A41B 9/04
2018/0368482 A1 * 12/2018 Chea ..... A41B 9/04
2019/0090552 A1 * 3/2019 Crump ..... A41B 9/023
2019/0150521 A1 * 5/2019 Pai ..... A41B 9/04
2021/0100681 A1 * 4/2021 Miles ..... A61F 5/4404
2021/0106068 A1 * 4/2021 Black ..... A61F 5/44
2021/0153570 A1 * 5/2021 Soldavini ..... A41D 13/0058
2022/0387229 A1 * 12/2022 Agami ..... A61F 13/5512
2023/0081210 A1 * 3/2023 Gaffney ..... A41D 13/0058 2/237
2023/0190518 A1 * 6/2023 Katrycz ..... A61F 7/02 607/108
2025/0082045 A1 * 3/2025 Moyles ..... A41B 9/001

* cited by examiner

COOLING UNDERGARMENT

CROSS-REFERENCE TO RELATED APPLICATIONS

This application claims the benefit of U.S. Provisional Patent Application Ser. No. 63/537,146 filed on Sep. 7, 2023, the entire contents of which are incorporated herein by reference.

BACKGROUND OF THE DISCLOSURE

The present disclosure relates to undergarments, such as those for women. More particularly, it relates to an elastically biased undergarment for imparting compression to defined body areas which has a plurality of compartments for positioning of a cooling pack therein.

Subsequent to pregnancy and delivery of an infant, women generally will find themselves enduring pain and other issues as a result of the childbirth. Where a natural childbirth has occurred, women can find they have both pelvic and abdominal pains. Where a woman has undergone childbirth by cesarean section, pain and swelling in the abdominal region is another common problem as well as issues that can arise with loose or stretched skin caused by the pregnancy. Due to the sheer duration of having to carry an infant during pregnancy, many women also suffer from issues of areas of stretched skin in the abdominal area.

In addition to seeking a non-drug manner for pain relief following pregnancy and delivery of their child, many women wish to help reduce the issues caused by pregnancy and natural or surgical delivery, such as sagging skin, dimples, or a scar caused by a caesarean section.

To provide support to the abdomen subsequent to pregnancy, many women will wear compressive garments. To help reduce swelling and pain, it is common to employ cold packs and in some cases heat to the affected areas.

The forgoing examples related to postpartum treatment are intended to be illustrative and not exclusive, and they do not imply any limitations on compressive undergarment device herein. Various limitations of the related art will become apparent to those skilled in the art upon a reading and understanding of the specification below and the accompanying drawings.

BRIEF DESCRIPTION OF THE EXEMPLARY EMBODIMENTS

The device herein disclosed and described provides a solution to the need for the application of compression to the body of the patient subsequent to, e.g., pregnancy resulting in a natural childbirth or abdominal procedures, including cesarean section. The undergarment provides such needed function through the provision of a garment which has selective areas of compression or support which surround selective areas of lesser compression which are formed of two-way stretching fabric material. By two-way stretching fabric is meant that the fabric is formed in a kit or weave which is elastic only in one direction, and will elongate in one direction, such as horizontally, but will have little or no stretch in the direction which is normal to the horizontal stretch directions, such as the vertical direction. Yarns for weaves and knits providing such two-way stretch, for example, can include Lycra® (elastic polyurethane) or spandex (e.g., a stretchy synthetic material) or other elastic yarns which will elongate under force and will return to substantially their original length, once the force to stretch is eliminated.

Additionally provided for employment concurrent with the selective compression of the garment are pockets which are strategically located on the compressive garment. One or both pockets may be employed to hold cold packs and, in some cases, warming packs to thereby communicate cold and heated therapy to strategic areas of the body of the user.

The body of the garment is formed of or includes a woven or knitted elastic material or yarn, such as spandex and/or similar elastic material in the weave or knit of the textile fabric forming the garment. These elastic yarns, once stretched to a position upon the user, will bias inward when the garment is stretched outward. This provides areas of compression to the undergarment.

A front panel area is located on the undergarment in a position to provide support to some areas of the body but a lesser amount of compression to areas of the body against which it is positioned. This front panel area is located on the garment to impart compression and pressure only in the abdominal area above the crotch area of the garment. The compressive force is achieved by employing a different weave or, more preferably, a differing knit configuration in fabric forming the front panel area with elastic fabric with compression force, since it may be stretched. The fabric used, preferably, has what is known as two-way stretch and provides significant elongation horizontally or in the direction parallel to the waist of the wearer and minimal elongation vertically or in the direction from head to toe of the wearer to thereby provide both support and compression.

Where the undergarment is formed of knitted fabric in the front panel area, the knit is configured in a fabric which will stretch in a horizontal direction or a direction substantially parallel to the waist of the wearer but will minimally elongate in the vertical direction running substantially normal to the horizontal direction. A rib knit configuration of the fabric forming the undergarment in this area is currently employed to provide this two-way horizontal stretch and compression and vertical support in the vertical direction.

Conventionally, rib knit fabrics may be formed to resist elongation along the direction of the formed ribs and will stretch in the two side directions transverse to the direction of these formed ribs. This rib knit panel area, thus, allows for some compression in the sideways direction to be communicated to the body of the wearer in this area while providing support to the body area contacted along the vertical direction of the ribs. However, the device/apparatus disclosed herein can be formed of any fabric which can be woven or knitted to have elongation and elastic resistance in the horizontal direction which, as noted, is parallel to the waist of the user and has minimal stretch and elongation in the vertical direction running normal to the horizontal direction.

In the knit configuration, yarns may be employed which yield four-way stretch but which limit the vertical stretch significantly to that of the horizontal stretch. The garment herein can be formed with yarns allowing stretch horizontally to be a multiple of the possible stretch and elongating vertically or normal to the horizontal elongation. Currently, fabric formed to have a first direction or vertical elongation which is 5-50 percent of that of the second or horizontal elongation have been employed and shown to provide the support needed to portions of the body requiring support and minimal elongation which concurrently provide other areas much more stretch and elongation.

Because the rib knit fabric primarily stretches in the sideways or horizontal direction, transverse to the direction of the individual ribs, it provides significant stretch to accommodate a sideways elongation where the user is moving or the user may be gaining or losing weight. In the vertical direction, such rib knit fabric will tend to elongate little and resist this stretch and thereby provide elongated vertical support to the area of the body of the user it contacts.

It was found, in experimentation, that undergarments having such a rib knit panel area which aligns with the abdomen of the wearer provided comfortable support vertically with minimal elongation while expanding horizontally or sideways when needed, such as when the wearer moves. Further, as the wearer loses weight and firms up their abdomen, the material contracts in the sideways or horizontal direction, as needed, to thereby maintain contact with the body of the changing user.

Areas surrounding this front panel area are currently formed of woven or knit fabric which has a four-way stretch and, conversely, provides a four-way compression contact with the body area, such as knit fabrics formed with interlocking loops and which may include elastic yarn, such as spandex. The tightness of the knit or the size of the loops to form such will have an effect on its ability to straighten out and will, thus, affect the amount of stretch, as well as the resulting compression imparted, once stretched. Where woven fabrics are employed for the areas surrounding the front panel of rib knit fabric, they will generally provide a biased stretch and compression.

According to another aspect, in the undergarment herein is the provision of secondary stretch panels formed in an area of the undergarment surrounding a crotch panel which will align with the lower buttocks of the wearer. These secondary stretch panels are also preferably formed of rib knit material to thereby provide ongoing vertical support while stretching horizontally.

According to an aspect, the undergarment described herein includes a first holding pocket positioned on the front portion of the undergarment within the front panel formed of rib knit fabric and a second holding pocket positioned along portions of the front and rear and through a crotch area of the undergarment.

Each of the first holding pocket and second holding pocket is configured to securely hold a thermal pack therein. Such thermal packs are available in modes which communicate thermal therapy to the body of the user. By thermal therapy herein is meant the communication of cooling or heat to the body of the wearer while thermal packs are mounted within compartments.

The provision of both the first holding pocket or compartment and second holding pocket or compartment in the garment body, according to an aspect, allows the user the ability to impart heat and/or cold therapy in one or both areas concurrently or singularly.

With respect to the above description, before explaining detailed aspects of the herein disclosed undergarment with removably engageable cooling packs and/or heat packs in detail, it is to be understood that the disclosure is not limited in its application to the details of construction and to the arrangement of the components in the following description or illustrated in the drawings.

The device/apparatus disclosed herein after testing and design, is capable of other embodiments and of being practiced and carried out in equivalent ways which may be discerned by those skilled in the art upon review of this disclosure. Also, it is to be understood that the phraseology and terminology employed herein are for the purpose of description and should not be regarded as limiting.

As such, those skilled in the art will appreciate that the conception upon which this disclosure is based, while disclosed in various modes thereof, may readily be utilized by those skilled in the art subsequent to review of this specification, as a basis for the design of other configurations of the undergarment herein and for carrying out the several purposes of the present disclosed undergarment device. It is important, therefore, that the claims be regarded as including these aspects of the device and its components and equivalent construction and methodology insofar as they do not depart from the spirit and scope of the present disclosure.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, unless provided with a different respective definition, the term substantially herein means plus or minus five percent.

According to an aspect, an undergarment is described for use by women after delivery of a child which will communicate compression.

According to an aspect, an undergarment is described that is configured for removable engagement with a thermal pack, e.g., a cooling pack and/or a heat pack to hold it in a compressed position to cover the area where a pocket holding it is positioned.

According to an aspect, an undergarment is described that includes areas of stretch which elongates in a one direction.

These and other aspects will be brought out in the following part of the specification, wherein detailed description is for the purpose of making full disclosure without placing limitations thereon.

BRIEF DESCRIPTION OF THE DRAWINGS

The accompanying drawings, which are incorporated herein and form a part of the specification, illustrate some, but not the only or exclusive examples of embodiments and/or features of the undergarment herein. It is intended that the embodiments and figures disclosed herein are to be considered illustrative rather than limiting. In the drawings.

DETAILED DESCRIPTION

Figure 1:
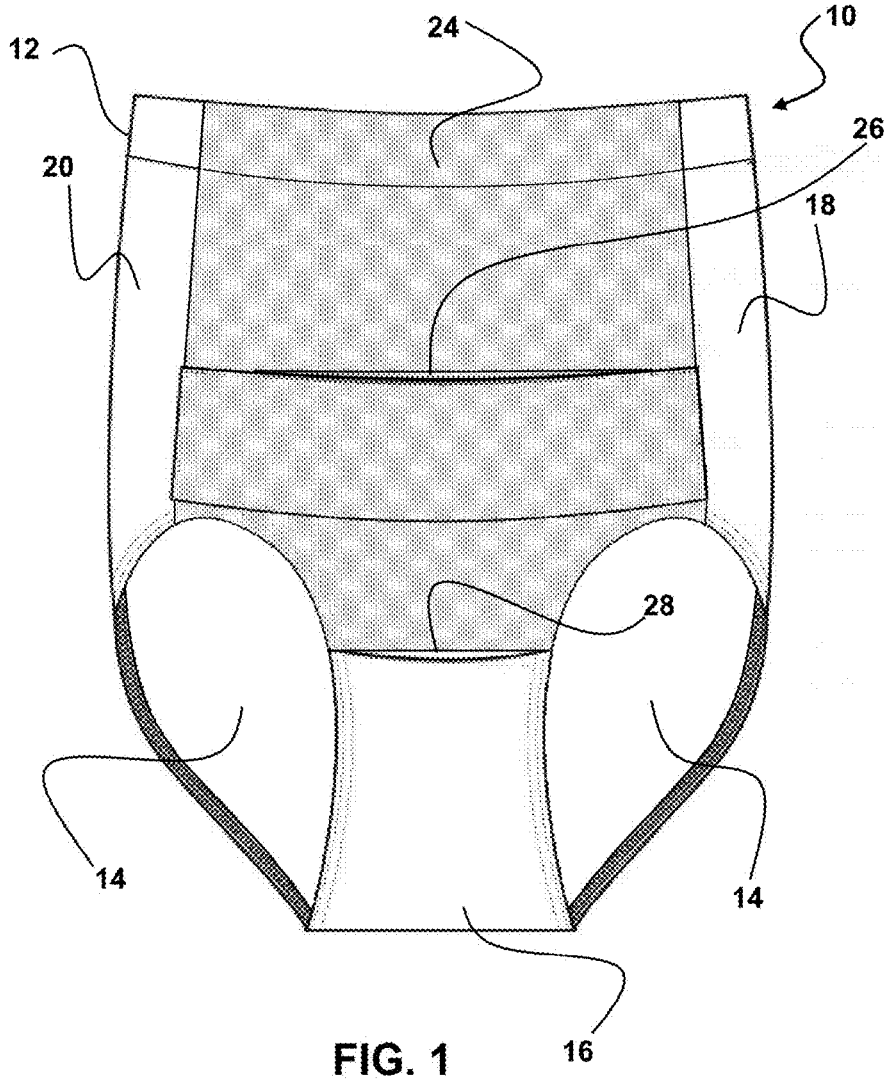
FIG. 1 depicts a frontal view of the undergarment herein showing a front panel area of the garment providing two-way stretch and compression as well as showing a first compartment and a second compartment configured to hold thermal packs securely.

In this description, the directional prepositions of up, upwardly, down, downwardly, front, back, top, upper, bottom, lower, left, right and other such terms refer to the underwear garment device as it is oriented and appears in the drawings and are used for convenience only.

The language is not intended to be limiting or to imply that the undergarment device or components thereto have to be used or positioned in any particular orientation.

Now referring to FIGS. 1-5, wherein similar components are identified by like reference numerals, there is seen in FIG. 1 a frontal view of the undergarment device 10 herein showing the body 12 of the undergarment device 10 configured for wearing upon a user as an undergarment. Leg openings 14 communicate through the sides of the body 12 and a crotch or center panel 16 is situated in between the leg openings 14 which is positioned to contact the crotch area of the wearer.

As noted, a first side 18 opposite a second side 20 of the body 12 are formed of textile fabric which is preferably woven or knitted to allow four-way stretching or elastic elongation in four directions so as to provide a substantially equal or even horizontal and vertical compressive contact thereof with the body portion of the user wearing the body 12. The fabric forming both the first side 18 and second side 20 of the undergarment extend around to the rear side (FIG. 2) of the body 12 of the undergarment and extend into a rear side panel 22.

As noted and according to an aspect, a front panel area 24 of the garment is situated in between the first side panel 18 and second side panel 20. The textile fabric forming this front panel area 24 is woven or knitted in a manner which allows for two-way stretch thereof along a horizontal line extending between the first side panel 18 and second side panel 20. In the vertical direction the textile fabric forming the front panel area 24, preferably, is woven or knitted in a configuration where there is substantially no stretch or elongation. This forms the front panel area 24 to provide contact against the abdomen of the wearer of the undergarment and provides two-way or horizontal elongate and stretch toward and between the side panels 18 and 20 which the fabric forming the front panel area 24 will contact. This horizontal stretch with minimal or no vertical stretch of the front panel area provides extra support to the abdomen of the user in the vertical direction somewhat akin to a vertical sling.

Figure 4:
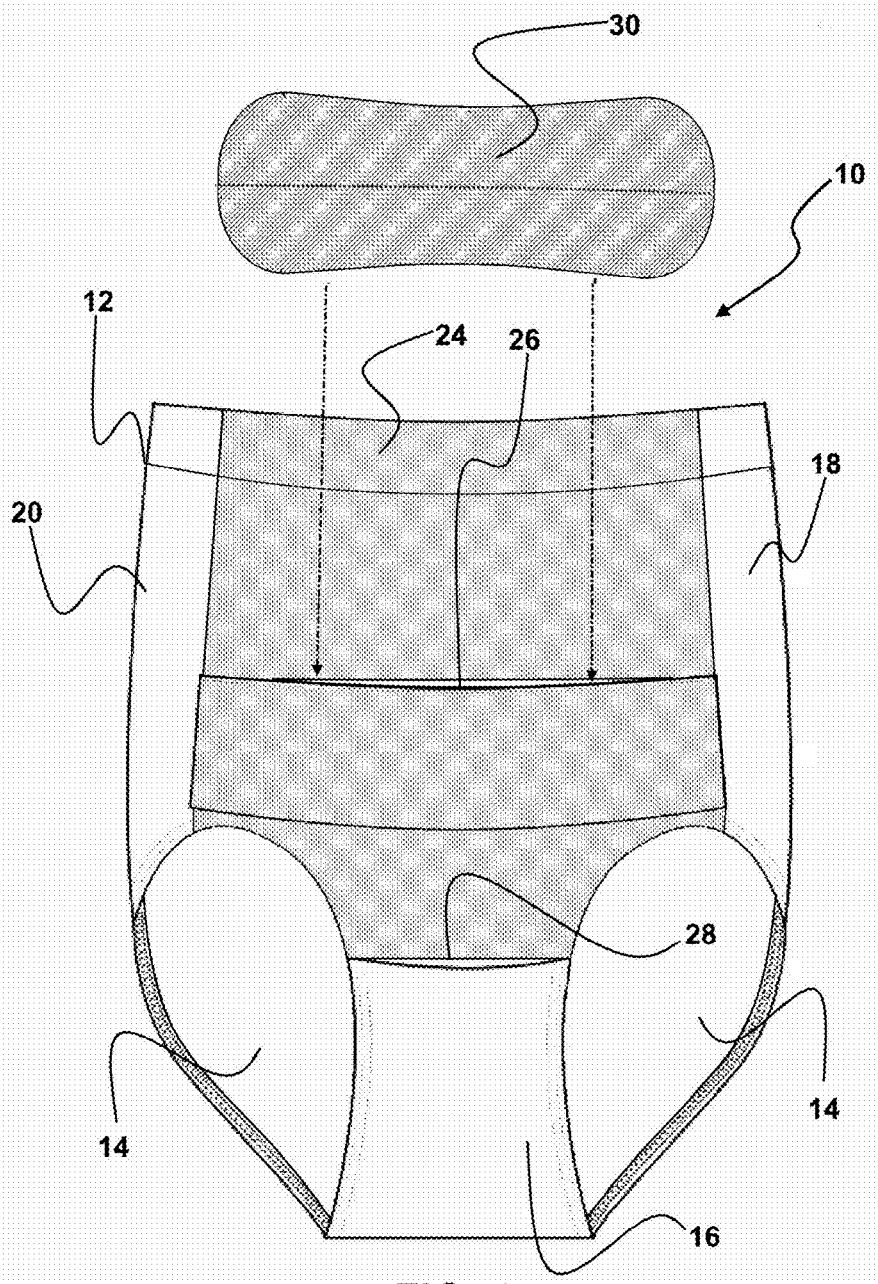
FIG. 4 depicts the undergarment device, as in FIG. 1, showing the thermal pack which is removably positionable in a horizontal positioning within the first compartment.

Running along a horizontal axis, a first compartment 26, positioned within the front panel area 24, is formed preferably of the same two-way or horizontal only stretch fabric forming the remainder of the front panel area 24. As shown in FIG. 4, this first compartment 26 is configured as a pocket, much like that of pants or a jacket, to hold an elongated thermal pack 30 in a removable engagement therein. By thermal pack herein is meant a gel pack or other pack which may be chilled or heated and which will act as a heat or cooling reservoir which will communicate heat or cold to the body of the wearer of the undergarment device 10.

Figure 3:
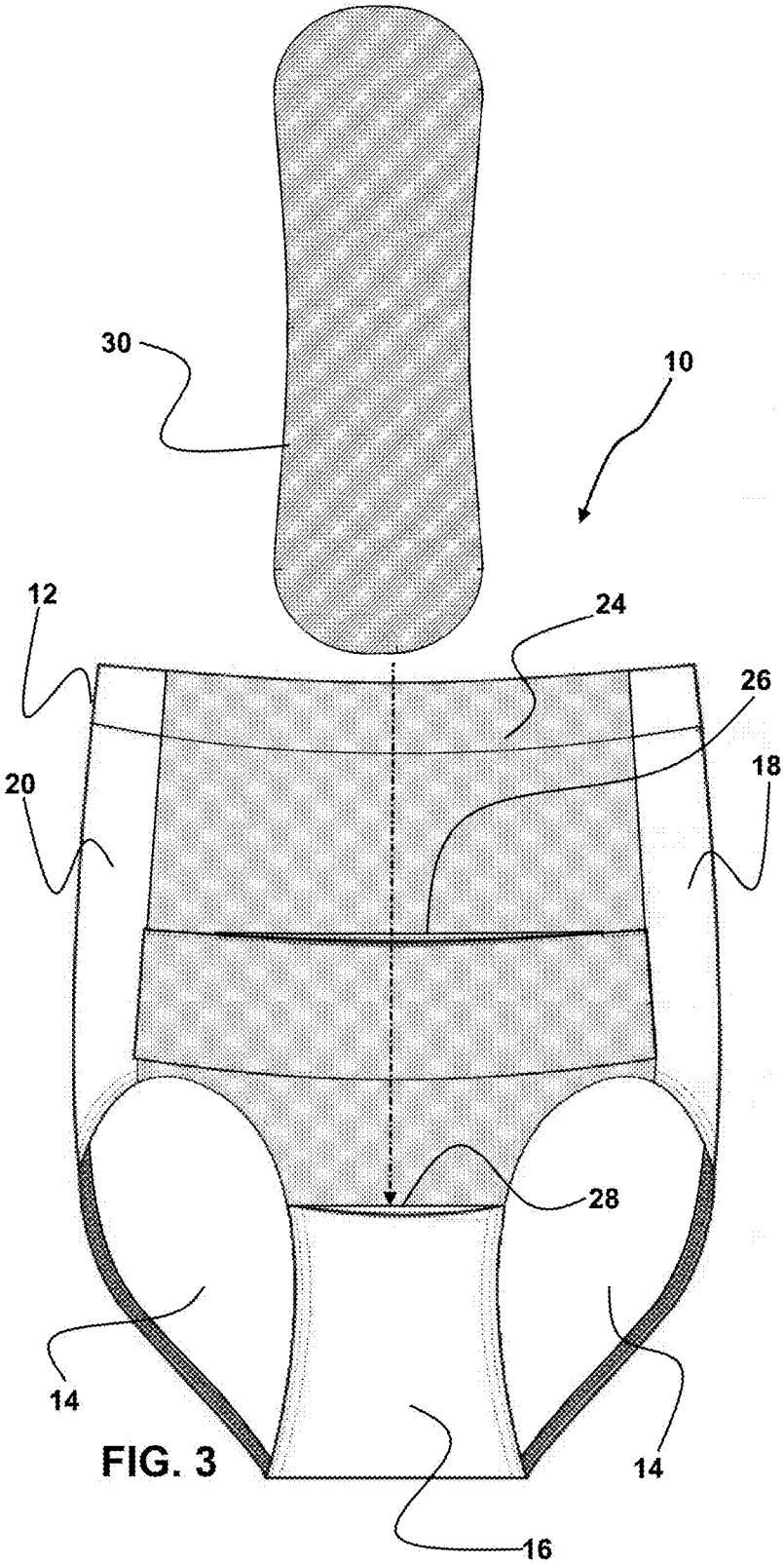
FIG. 3 depicts a view of the device, as in FIG. 1, showing the thermal pack which is removably engageable into the second compartment.

The second compartment 28, shown in FIG. 1, is configured to removably engage and hold a thermal pack 30, such as shown in FIG. 3. This second compartment 28 is hourglass-shaped in that it follows the contour and curve of the center panel 16 and runs along a portion of the front of the center panel 16 and between the two leg openings 14 to the rear side 22. This positions the thermal pack 30 within the second compartment 28 to provide heat or cold to the crotch area of the wearer along the path of the center panel 16.

The wearer of the undergarment device 10 can, thus, choose to position thermal packs 30 in one or both of the first compartment 26 and/or second compartment 28. Alternatively, they may simply wear the undergarment without any thermal packs 30 inserted wherein they will have the vertical support provided by the fabric forming the front panel 24 area and the horizontal stretch and elongation and resulting compression in the front panel 24 area.

Figure 2:
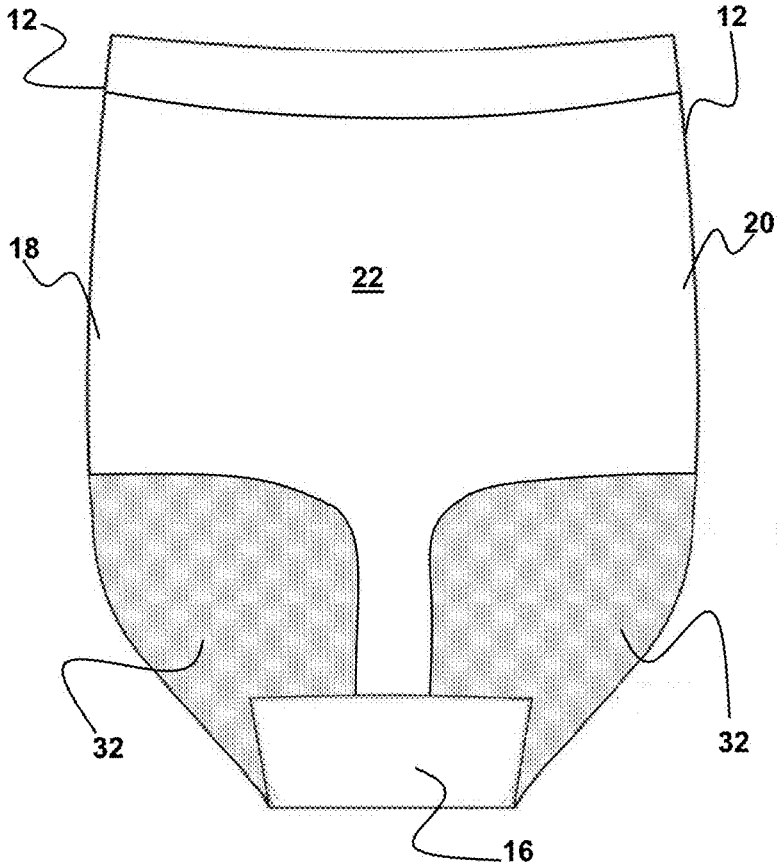
FIG. 2 shows a rear view of the undergarment herein showing a rear section of the second compartment and showing two secondary panel areas which also employ fabric therein which elongates in the sideways direction and stretches significantly less in the vertical direction.

Shown in FIG. 2 is the rear view of the undergarment device 10 herein. Also shown are optional secondary panels 32. Each of the secondary panels 32 are located at and form lower ends of the rear panel of the undergarment device 10 in positions for contact against the buttocks of the wearer when the device 10 is in an as-used positioning with the legs of the user projecting through the respective leg openings 14. As with the front panel, the fabric forming the secondary panels 32 is two-way stretch fabric, such as a rib knit material, which has minimal or no elongation in the vertical direction to provide support vertically and will stretch horizontally and provide elastic support in a horizontal direction running between the two sides 18 and 20.

As noted, FIG. 3 depicts a view of the undergarment device 10, as in FIG. 1, and shows insertion of a thermal pack in the vertical direction into a removable engagement of the thermal 30 pack into the U-shaped second compartment 28. This insertion operatively positions a thermal pack 30 to a contact position of the groin area and the area within the area of the center panel 16 between the two legs of the user.

Insertion of a thermal pack 30 into the first compartment 26 is shown in FIG. 4. As noted, the elongated thermal pack 30 is located therein with the axis of the thermal pack 30 running in the horizontal direction along an imaginary horizontal line extending between the first side 18 and second side 20 of the body 12 of the garment device 10. In this positioning, the heat or cold from the thermal pack 30 will be well adapted to contact against the abdomen of the user and in most cases will contact against any scars or sutures which the user may have due to surgery required by the delivery of the infant.

FIG. 4 depicts the undergarment device, as in FIG. 1, showing the thermal pack which is removably positionable in a horizontal positioning within the second compartment 28.

Figure 5:
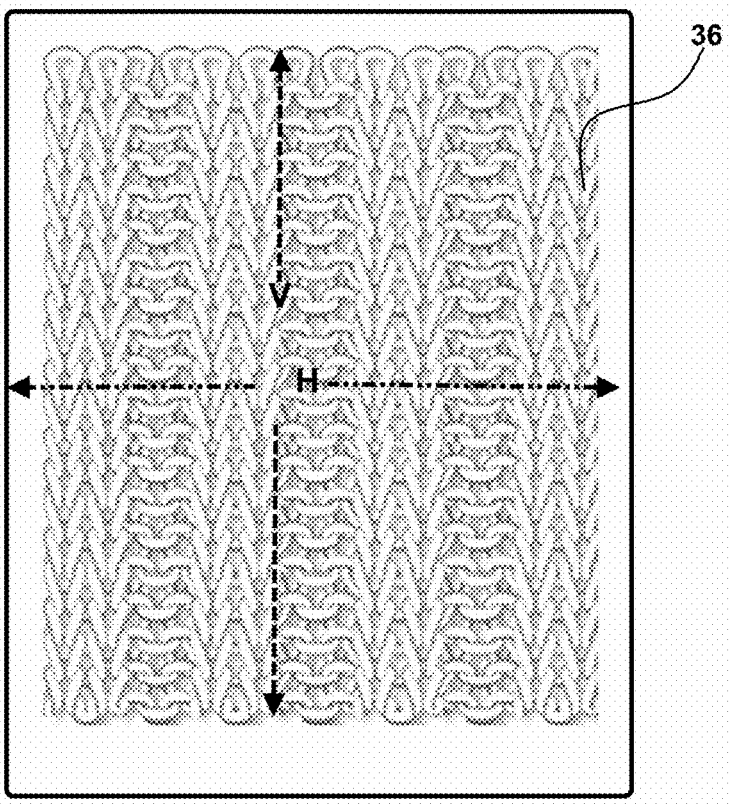
FIG. 5 shows a depiction of an example of knit fabric with significantly more stretch and elastic elongation in the horizontal direction H than the elongation in the vertical direction V.

Shown in FIG. 5 is a depiction of an example of two-way stretch knit fabric 36 which is formed with yarn and knit configurations which have significantly more stretch and elastic elongation in the horizontal direction H than in the elongation in the vertical direction V. This allows for the garment to have areas of lesser and more compression in different portions of the garment.

As noted above, currently, where two-way fabric is employed in the garment, the fabric is knitted or woven in a knit or woven configuration and/or with yarns which have a first direction of elastic elongation or vertical elongation V which is from 5-50 percent of that of the second or horizontal H elastic elongation. Currently, a lower elongation or stretch in a vertical V or first direction of elongation which is 5-25 percent of the stretch or elongation in a horizontal H or second direction has been shown to work well with postpartum wearers.

While all of the fundamental characteristics and features of the undergarment device configured for the concurrent communication of compression and cooling and/or heat to one or a plurality of areas of the body have been shown and described herein, with reference to particular embodiments thereof, a latitude of modification, various changes and substitutions are intended in the foregoing disclosure and it will be apparent that in some instances, some features of the disclosure may be employed without a corresponding use of other features without departing from the scope as claimed and as set forth. It should also be understood that various substitutions of components for equivalent components and modifications variations may be made by those skilled in the art without departing from the spirit of this disclosure.

What is claimed is:

1. An undergarment, comprising: a garment body having a rear panel and having a front panel opposite said rear panel; a first side panel positioned between said rear panel and said front panel; a second side panel positioned between said rear panel and said front panel, said second side panel being on an opposite side of said body from said first side panel; a center panel extending from a lower end of said front panel to an engagement with said rear panel; leg openings positioned upon opposite sides of said center panel; a first compartment extending entirely across said front panel and positioned at a lower abdomen area on said front panel, and the first compartment comprising a first compartment opening at an upper end of said first compartment, wherein said first compartment opening is spaced apart from a waistband of the undergarment, said first compartment sized for positioning of a thermal pack therein; and a second compartment, said second compartment extending along said center panel between said leg openings, the second compartment comprising a second compartment opening at an upper end of said second compartment, said second compartment sized for positioning of said thermal pack therein; and whereby said front panel and the first compartment limit stretching in one direction and the front panel is configured to forms a compressive contact in a horizontal direction against a body of a wearer of the undergarment.

2. The undergarment of claim 1 wherein said first side panel and said second side panel concurrently impart a compressive contact thereof against the body of the wearer of the undergarment.

3. The undergarment of claim 2, further comprising:

a first secondary panel located at a lower end of said rear panel;

a second secondary panel located at said lower end of said rear panel on an opposite side of said garment body from said first secondary panel;

whereby said first secondary panel and said second secondary panel are configured to limit stretch in one direction and thereby impart support to buttocks of the wearer and positioned for contact against the buttocks of the wearer.

4. The undergarment of claim 3 additionally comprising:

said first compartment positioned to communicate thermal therapy from said thermal pack therein to the lower abdomen of the wearer;

said second compartment positioned in a location aligning with a groin of the wearer to thereby communicate thermal therapy from a thermal pack to the groin of the wearer.

5. The undergarment of claim 2, further comprising:

said first compartment positioned to communicate thermal therapy from said thermal pack therein to the lower abdomen of the wearer;

said second compartment positioned in a location aligning with a groin of the wearer to thereby communicate thermal therapy from said thermal pack to the groin of the wearer.

6. The undergarment of claim 1, further comprising:

a first secondary panel located at a lower end of said rear panel;

a second secondary panel located at said lower end of said rear panel on an opposite side of said garment body from said first secondary panel;

whereby said first secondary panel and said second secondary panel are configured to limit stretch in one direction and thereby impart support to buttocks of the wearer and positioned for contact against the buttocks of the wearer.

7. The undergarment of claim 6, further comprising:

said first compartment positioned to communicate thermal therapy from said thermal pack therein to the lower abdomen of the wearer;

said second compartment positioned in a location aligning with a groin of the wearer to thereby communicate thermal therapy from said thermal pack to the groin of the wearer.

8. The undergarment of claim 1, further comprising:

said first compartment positioned to communicate thermal therapy from said thermal pack therein to the lower abdomen of the wearer;

said second compartment positioned in a location aligning with a groin of the wearer to thereby communicate thermal therapy from said thermal pack to the groin of the wearer.

9. An undergarment, comprising: a body having a rear panel and a front panel, the front panel positioned opposite the rear panel; a first side panel positioned between the rear panel and the front panel; a second side panel positioned between the rear panel and the front panel, the second side panel being on an opposite side of the body from the first side panel; a crotch panel extending between the front panel and the rear panel; a first compartment positioned adjacent the front panel and extending entirely across the front panel, the first compartment comprising an opening at an upper end thereof, wherein the first compartment opening is spaced apart from a waistband of the undergarment; and a second compartment positioned adjacent the crotch panel and extending between the leg openings, the second compartment comprising an opening at an upper end thereof; whereby the front panel and the first compartment limit stretching in one direction and the front panel and the first compartment together are configured to form a compressive contact against a body of a wearer of the undergarment.

* * * * *